US005650797A

United States Patent [19]

Okada

[11] Patent Number: 5,650,797

[45] Date of Patent: Jul. 22, 1997

[54] LIQUID CRYSTAL DISPLAY

[75] Inventor: Shinjiro Okada, Isehara, Japan

[73] Assignee: Canon Kabushiki Kaisha, Tokyo, Japan

[21] Appl. No.: 422,774

[22] Filed: Apr. 14, 1995

Related U.S. Application Data

[63] Continuation of Ser. No. 973,742, Nov. 9, 1992, abandoned.

[30] Foreign Application Priority Data

Nov. 11, 1991 [JP] Japan ..... 3-321519
Nov. 11, 1991 [JP] Japan ..... 3-321520

[51] Int. Cl.[6] ..... G09G 3/36

[52] U.S. Cl. ..... 345/97; 345/94

[58] Field of Search ..... 345/95–97, 94; 359/56

[56] References Cited

U.S. PATENT DOCUMENTS

| | | | |
|---|---|---|---|
| 4,712,873 | 12/1987 | Kanbe et al. . | |
| 4,712,877 | 12/1987 | Okada et al. . | |
| 4,898,456 | 2/1990 | Okada et al. . | |
| 4,902,107 | 2/1990 | Tsuboyama et al. . | |
| 4,941,736 | 7/1990 | Taniguchi et al. . | |
| 5,026,144 | 6/1991 | Taniguchi et al. . | |
| 5,034,735 | 7/1991 | Inoue et al. | 359/56 X |
| 5,061,044 | 10/1991 | Matsunaga | 345/97 X |
| 5,128,663 | 7/1992 | Coulson | 345/94 |
| 5,153,755 | 10/1992 | Higa | 359/56 X |
| 5,521,727 | 5/1996 | Inaba et al. | 345/94 |

FOREIGN PATENT DOCUMENTS

| | | | |
|---|---|---|---|
| 0453856 | 10/1991 | European Pat. Off. | 345/97 |
| 61-94023 | 5/1986 | Japan . | |
| 3-73127 | 3/1991 | Japan . | |
| 4-218022 | 8/1992 | Japan . | |
| 2218842 | 11/1989 | United Kingdom | 345/97 |

OTHER PUBLICATIONS

Mol. Crys. Liq. Crys. vol. 94, No. 1 and 2, 1983, Clark et al., pp. 213–234, "Ferroelectric Liquid Crystal Electro–Optic Using the Surface Stabilized Structure".

*Primary Examiner*—Richard Hjerpe
*Assistant Examiner*—Amare Mengistu
*Attorney, Agent, or Firm*—Fitzpatrick, Cella, Harper & Scinto

[57] ABSTRACT

A ferroelectric liquid crystal display is provided with a scanning electrode group and a signal electrode group arranged in matrix and a displaying portion between these electrode groups filled with ferroelectric liquid crystal which exhibits bistable optical transmittance in accordance with an applied electric field. Driving signals for the display are formed by a pulse to completely reset all the pixels on a selected scanning electrode to one stable condition and a plurality of subsequent pulses, having opposite polarities to each other, to determine the content to be written into a pixel. The pixel width of each subsequent pulse is shorter than the pulse width of the preceding pulses.

4 Claims, 8 Drawing Sheets

$$T_{total} = T_a + T_b + T_c = 4dt + 4 \cdot \frac{5}{7} dt + 4 \cdot \frac{3}{7} dt \doteq 8.6dt$$

V = 0

V<Vth

Vth<V<Vsat

Vsat<V

LIQUID CRYSTAL DISPLAY

This application is a continuation of application Ser. No. 07/973,742, filed Nov. 9, 1992 now abandoned.

BACKGROUND OF THE INVENTION

1. Field of the Invention

The present invention relates to a liquid crystal display using ferroelectric liquid crystal to perform tonal displays.

2. Related Background Art

As display elements using ferroelectric liquid crystal (FLC), there has hitherto been known an element such as disclosed in Japanese Patent Laid-Open Application No. 61-94023, wherein ferroelectric liquid crystals are injected into the orientationally processed liquid crystal cells having two glass substrates oppositely arranged with a cell gap of 1 to 3 μm therebetween and transparent electrodes being formed on the opposite faces thereof.

The above-mentioned display element using ferroelectric liquid crystal is characterized in that with the spontaneous polarization of the ferroelectric liquid crystal, this element can utilize the coupling force between the outer electric field and the spontaneous polarization for switching, and that it is possible to perform switching by the application of the outer electric field because the major axial direction of the ferroelectric liquid crystals corresponds to the polarization direction of the spontaneous polarization one to one.

As a ferroelectric liquid crystal, chiral smectic liquid crystal (SmC*, SmH*) is generally used. This liquid crystal presents the torsional orientation for the major axes of the liquid crystal molecules in bulk, but by placing this liquid crystal in the cell gap of approximately 1 to 3 μm as described above, it is possible to eliminate such a torsion given to the major axes of the liquid crystal molecules (P213–P234 N. A. CLARK et al, MCLC. 1983, Vol 94).

The ferroelectric liquid crystal is mainly used for binary (black and white) display elements by enabling the two stabilized states to be light transmitting and shielding conditions. It is also possible to use the ferroelectric liquid crystal for a multivalue display, that is, an intermediate tonal representation. One of the intermediate tonal display methods is such that an intermediate light transmitting condition is produced by controlling the area ratio of bistable condition in pixels. Hereinafter, this method (area modulation method) will be described in detail.

FIG. 5 shows the relation between the switching pulse amplitude and transmittivity of a ferroelectric liquid crystal element, and is a graph plotting it with the amount of the transmitting light I as function of the amplitude V of the single pulse obtained after having applied a single pulse of one-way polarity to the cell (element) in a totally shielded state (black). When the pulse amplitude is less than the threshold value $V_{th}$ ($V<V_{th}$), the amount of the transmitted light will not vary. The transmitting state of the pixels after the application of pulse is not different as shown in FIG. 6B from the state of the pixels before the application thereof as shown in FIG. 6A. When the pulse amplitude V exceeds the threshold value, portions of the pixels ($V_{th}<V<V_{sat}$) change to the other stable state, that is, the light transmitting condition represented in FIG. 6C, and an intermediate amount of transmitting light is shown as a whole. Accordingly, if the pulse amplitude V becomes great enough to exceed the saturation value $V_{sat}$ ($V_{sat}<V$), the amount of light reaches a constant value because the entire pixel become light transmittable as shown in FIG. 6D.

Thus, the area modulation method is to represent intermediate tones by controlling voltage so as to enable the pulse amplitude V to be $V_{th}<V<V_{sat}$.

However, with a simple driving method such as this, there is still room for improvement, as set forth below.

The relation between a voltage V and an amount of transmitted light I shown in FIG. 5 depends on the cell thicknesses and temperatures. Accordingly, there takes place an event that different tonal levels are represented for applied pulses of a same voltage amplitude if distributions of cell thicknesses and temperatures are present in the display panel.

FIG. 7 is a view for explaining this event, and it is a graph showing the relation between the voltage amplitude V and the amount Of transmitting light I as in FIG. 5, but there are shown two curved lines: a curved line H which shows the relation at high temperatures and a curved line L which shows the relation at low temperatures. In other words, in a display (display element) having a large display size, the temperature distribution often occurs in the same panel (display portion). Therefore, even if the representation of an intermediate tone is attempted at a certain voltage $V_{ap}$, there are some cases that uniform display cannot be obtained because the intermediate tonal level becomes uneven over an area from the amount of transmitting light $I_1$ to that of $I_2$ as shown in FIG. 7.

Now, with a view to solving this, a four-pulse method is designed by the inventor hereof as proposed in Japanese Patent Gazette No. 4-218022. As shown in FIG. 8, this driving method is to obtain an equally reversed area ultimately by applying a plurality of pulses A to D to the low threshold portion and high threshold portion on a same scanning line in the panel. Hereinafter, the description will be made of the four-pulse method in conjunction with an area tonal method which controls the domain area of black and white in pixels. However, the four-pulse method itself is fundamentally a driving method to be used commonly for the elements thereby to modulate the transmittivity of pixels by the application of a voltage or by means of pulse widths. For example, therefore, this method is applicable as a light amount adjustment method to the chiral smectic phase C having the orientation of spiral pitches of less than the wavelength of light, a short spiral of less than 0.7 μm, for example, because the method can be used in an orientational mode where the amounts of transmitted light vary without the domain walls to be formed in pixels.

Nevertheless, there is still room for improvement in the foregoing four-pulse method as set forth below.

Firstly, as shown in FIG 8,. according to the four-pulse method, a pulse A is applied at first to the pixels on a selected scanning line. Then, the pulses B, C, and D are applied sequentially. At this juncture, however, the write pulses A, B, C, and D to be applied are affected respectively by the preceding pulses. Consequently, due to the voltage of the preceding pulse, the voltage (threshold value) required to reverse the liquid crystal is slightly different when the following pulse is to be applied. A phenomenon of this kind hinders setting of the voltage value of a pulse B. When the variation of the threshold value due to the presence of a preceding pulse is small, it may be possible to accept it as an allowable error (even in such a case, the accuracy of the tonal representation is lowered). However, if the variation is great, it becomes impossible to use the four-pulse method itself. This is due to the fact that the four-pulse method is operative on the assumption that the four pulses are of an equal value when applied.

Secondly, the pulse A in FIG. 8 is a resetting pulse and there is no problem because a voltage which exceeds the threshold value is applicable. However, for the other pulses B, C, and D, it is necessary to provide domain walls i, j, and k in the pixels. To each of them, a voltage extremely close to the threshold value is applied. When a switching is conducted with a voltage which is extremely close to the threshold value for liquid crystal molecule but not sufficiently above the threshold value, the position of the domain walls is significantly affected by the pulse applied immediately preceding thereto. Such an effect of the immediately preceding voltage as this is not so serious a problem when the variation of the voltage value is small. However, if the variation is great, some improvements are required.

Thirdly, such an effect as this can also be produced by a voltage immediately after writing. As shown in FIG. 8, even if the domain wall j is set up by the pulse C, for example, the position of the domain wall j will be shifted by the proceeding pulse D if it has a voltage which is greater than a certain value. In other words, a write pulse is easily affected by the cross talk from the following pulse. This is a point which should be improved.

Now, fourthly, even when the effects produced by the variation of the threshold value and cross talk as described in the preceding paragraphs 1 to 3 are not so great, the number of write pulses is many as compared with the methods described in conjunction with FIGS. 5 and 6A to 6D. In other words, in the methods shown in FIGS. 5 and 6A to 6D require only pulses A and B in FIG. 8, but in the four-pulse method, pulses C and D are further required. This means that the time (frame time) required to write the entire surface of the panel is prolonged that much. As a result, if the entire image plane should be written all the time, the quality of display is affected, not to mention the display of animated representations, and in the worst case, no representation is possible except still images.

As described above, the four-pulse method itself has the foregoing first to third factors to result in errors and the fourth problem of delay in displaying velocity.

SUMMARY OF THE INVENTION

In consideration of these problems existing in the conventional technique, the present invention is designed, and it is an object of the invention to improve the displaying velocity of the four-pulse method for a ferroelectric liquid crystal display.

In order to achieve the above-mentioned object, there is provided for a ferroelectric liquid crystal display, in which a scanning electrode group and a signal electrode group are arranged in matrix, and then a display unit filled with the ferroelectric liquid crystal having bistability in the direction of electric field is arranged between these electrode groups for image or information display, comprising means for applying to the ferroelectric liquid crystal through each of the electrode groups the driving signals which are produced to determine the contents to be written to one pixel by a plurality of pulses, that is, a pulse causing the entire pixels on a selected electrode to be reset completely to the stable condition, and a plurality of the following pulses having the shorter pulse width than the pulse width of the preceding pulse.

Here, it is possible to equalize the values of wave height for each of the pulses to determine the foregoing content to be written. Also, as regards the entire pixels, it is desirable to arrange a structure so that the reversal threshold value in the pixel can be distributed in a stabilized condition.

DETAILED DESCRIPTION OF THE PREFERRED EMBODIMENTS

According to the present invention, in order to improve the drawback such that it takes a longer time to represent one image plane with the four-pulse method which performs the tonal display by the application of voltage modulation, the pulse width of a write pulse is arranged so that the pulse width of the following pulse is shorter than the pulse width of the preceding pulse when writing is executed by a plurality of pulses for pixels on a selected scanning line. Thus, for the pixel having a low threshold value, the content to be written is determined by the pulse of a pulse width which is shorter than the pixel having a high threshold value ultimately. In general, the pulse voltage value applicable to a liquid crystal panel is determined by the specifications of pressure resistance and others for a driving IC to be used. Conventionally, in switching pixels having a low threshold value, the pulse voltage values are controlled by making the pulse width constant thereby to perform tonal representations. In the present invention, however, the pulse width is shortened as well as the pulse voltage value is controlled; thus attaining the tonal representations. Therefore, although the applying voltage itself is set higher than conventionally set, the pulse width is shortened and thus the display velocity is enhanced.

Figure 1:
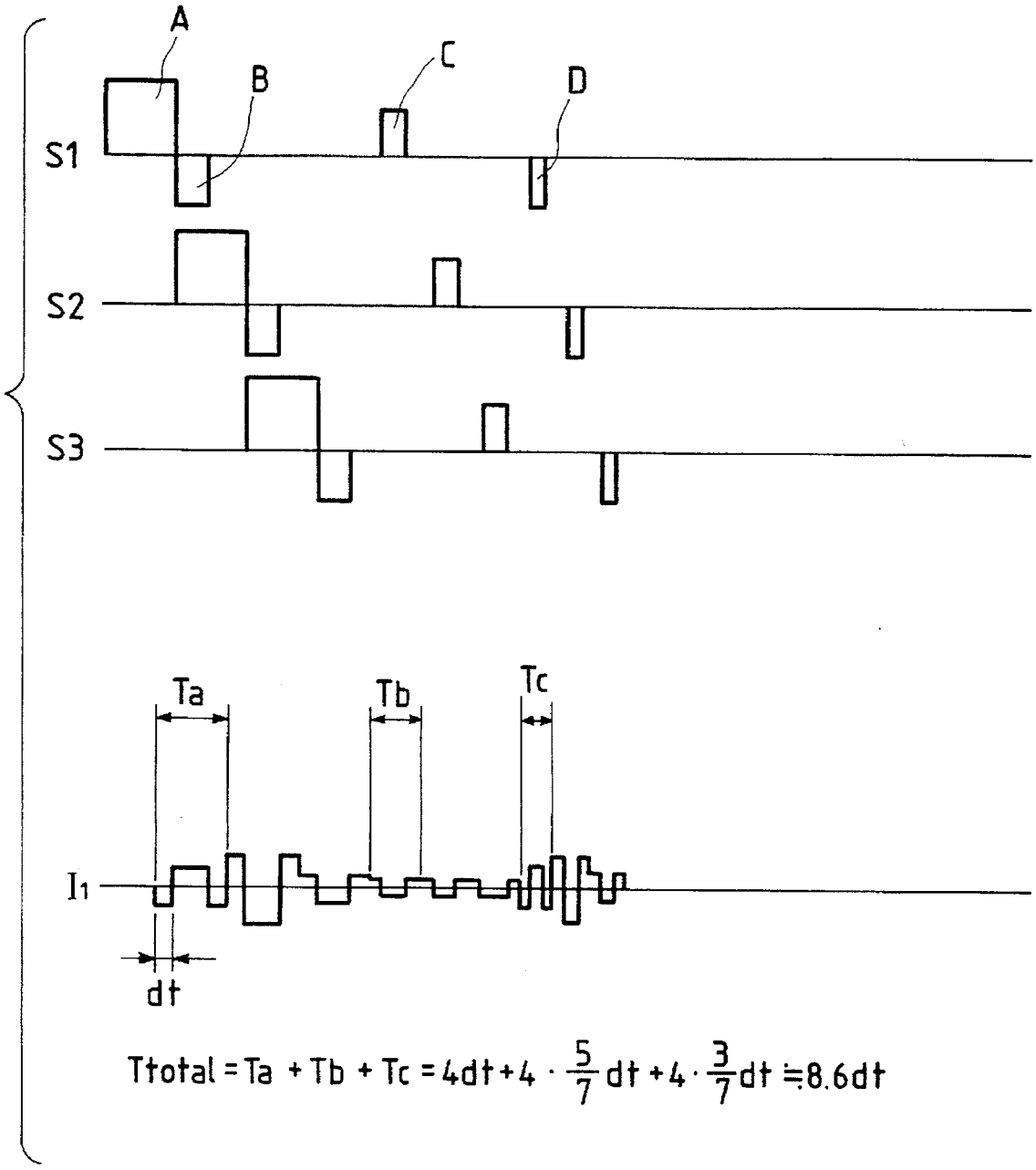
FIG. 1 is a time chart showing the scanning signals and information signals in a ferroelectric liquid crystal display according to an embodiment of the present invention.
Figure 4:
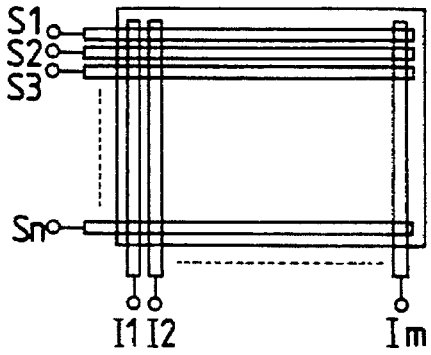
FIG. 4 PRIOR ART
FIG. 4 is a view schematically showing the electrode arrangement in a general matrix element.
Figure 5:
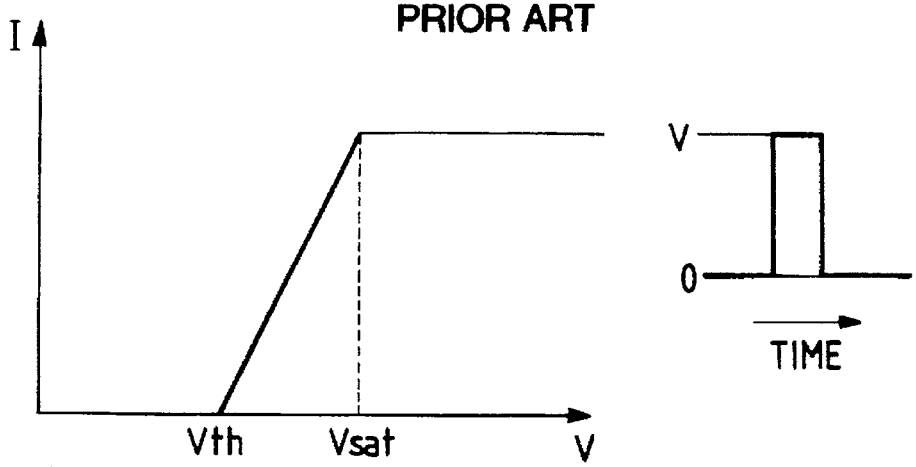
FIG. 5 PRIOR ART
FIG. 5 is a graph showing the relation between the switching pulse amplitude and transmittivity.
Figure 6A:
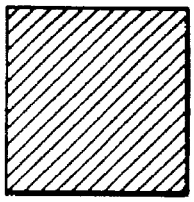
FIG. 6A PRIOR ART
FIGS. 6A to 6D are views schematically showing the pixel states in a conventional tonal representation.
Figure 6B:
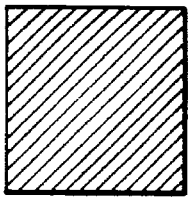
FIG. 6B PRIOR ART
Figure 6C:
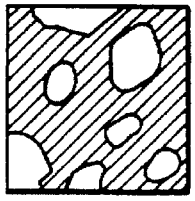
FIG. 6C PRIOR ART
Figure 6D:
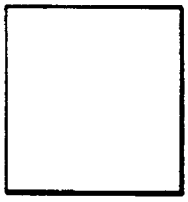
FIG. 6D PRIOR ART
Figure 7:
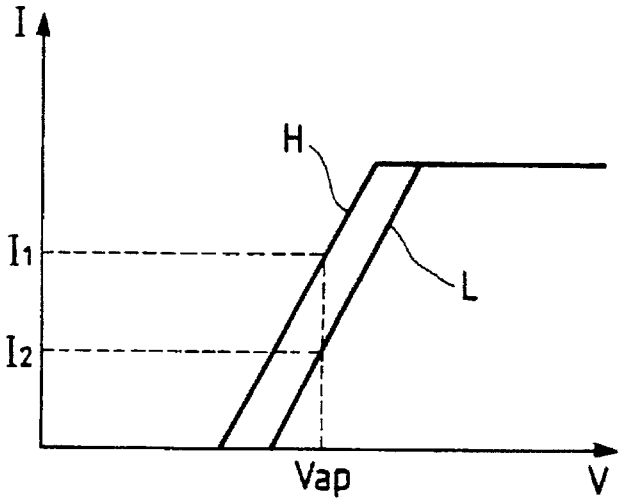
FIG. 7 PRIOR ART
FIG. 7 is a graph showing the relation between the voltage amplitudes and the amounts of transmitting light at different temperatures.

FIG. 1 is a time chart showing the scanning signals S1 to S3 and the information signal $I_1$ sequentially applied in the ferroelectric liquid crystal display according to an embodiment of the present invention. Each of the scanning signals is formed by four pulses. In other words, FIG. 1 shows for explanation the matrix driving waveforms in a case where there are three scanning signal lines for one information signal line. In this respect, the electrodes of the matrix element include in general a number of scanning signals S1 to Sn lines and information signals I1 to In lines as shown in FIG. 4.

Figure 2:
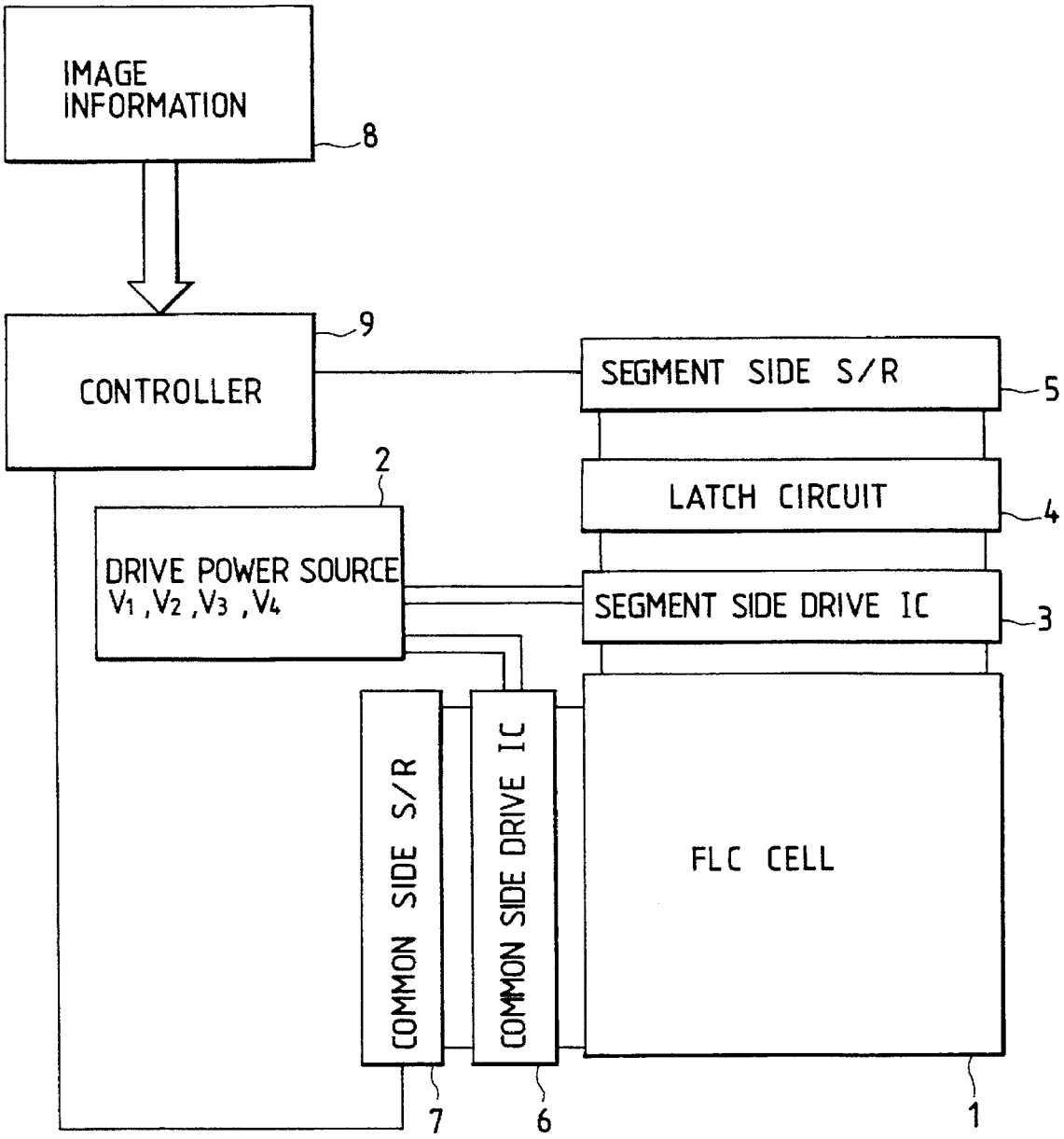
FIG. 2 is a block diagram showing means for supplying the scanning signals and information signals as shown in FIG. 1 to a liquid crystal cell.

FIG. 2 is a block diagram showing means for supplying these scanning signals and information signals to a liquid crystal cell. As shown in FIG. 2, in order to supply a tonal signal having a plurality of voltage levels to the liquid crystal cell 1, the structure is arranged in such a manner that the digital tonal signal which is supplied through a latch circuit 4, that is $2^4$=16 tonal signals in a case of four bits, for example, is converted into an analogue signal consisting of 16 information signal pulses by a driving IC 3 on the segment side with a DA converter being provided therefor, and then it is applied to the segmental line information signal line of the liquid crystal cell 1. In this case, the driving IC 6 on the common side (scanning) produces scanning signals by a distributional method using analogue switching for a driving power source 2. In this respect, in FIG. 2, a reference numeral 5 designates an S/R on the segment side; 7, an S/R on the common side; 9, a controller to control them; and 8, an image information source. As means for supplying analogue signals to the information signal lines besides this, it may be possible to use a method wherein capacitances are arranged in parallel in the driving IC unit thereby to hold inputted analogue signals directly.

Figure 9:
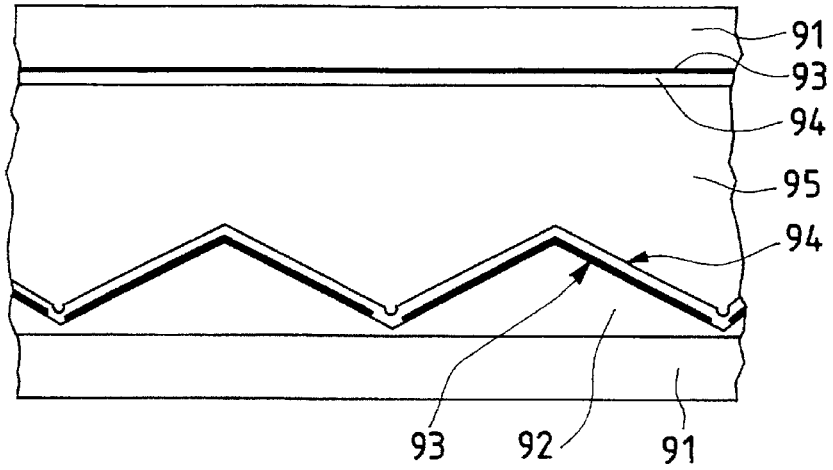
FIG. 9 is a cross-sectional view partially showing the liquid crystal cell of a ferroelectric liquid crystal display according to an embodiment of the present invention.

For the cell to which the driving signals (S1, S2, S3, and $I_1$) are thus applied, the threshold 10 value is distributed by varying the cell thickness in the pixel as shown in FIG. 9. In FIG. 9, a reference numeral 91 designates glass substrates; 92, an UV hardened resin provided on one of the glass substrates 91; 93, ITO electrodes constituting scanning signal line and information signal line; 94, orientational films; and 95, a ferroelectric liquid crystal (FLC).

The orientational film 94 is LQ-1802 manufactured by Hitachi Chemicals, Inc. The orientational processing is performed by rubbing the upper and lower substrates 91 in the same directions. However, observing from the surface of the cell, the angle formed by both of the rubbing directions is approximately 10° in the advancing direction of a clockwise screw toward the upper substrate when the clockwise screw is rotated in the rubbing direction of the upper substrate from the rubbing direction of the lower substrate. The cell thickness is distributed from 1.0 to 1.4 μm in each of the pixels.

Figure 8:
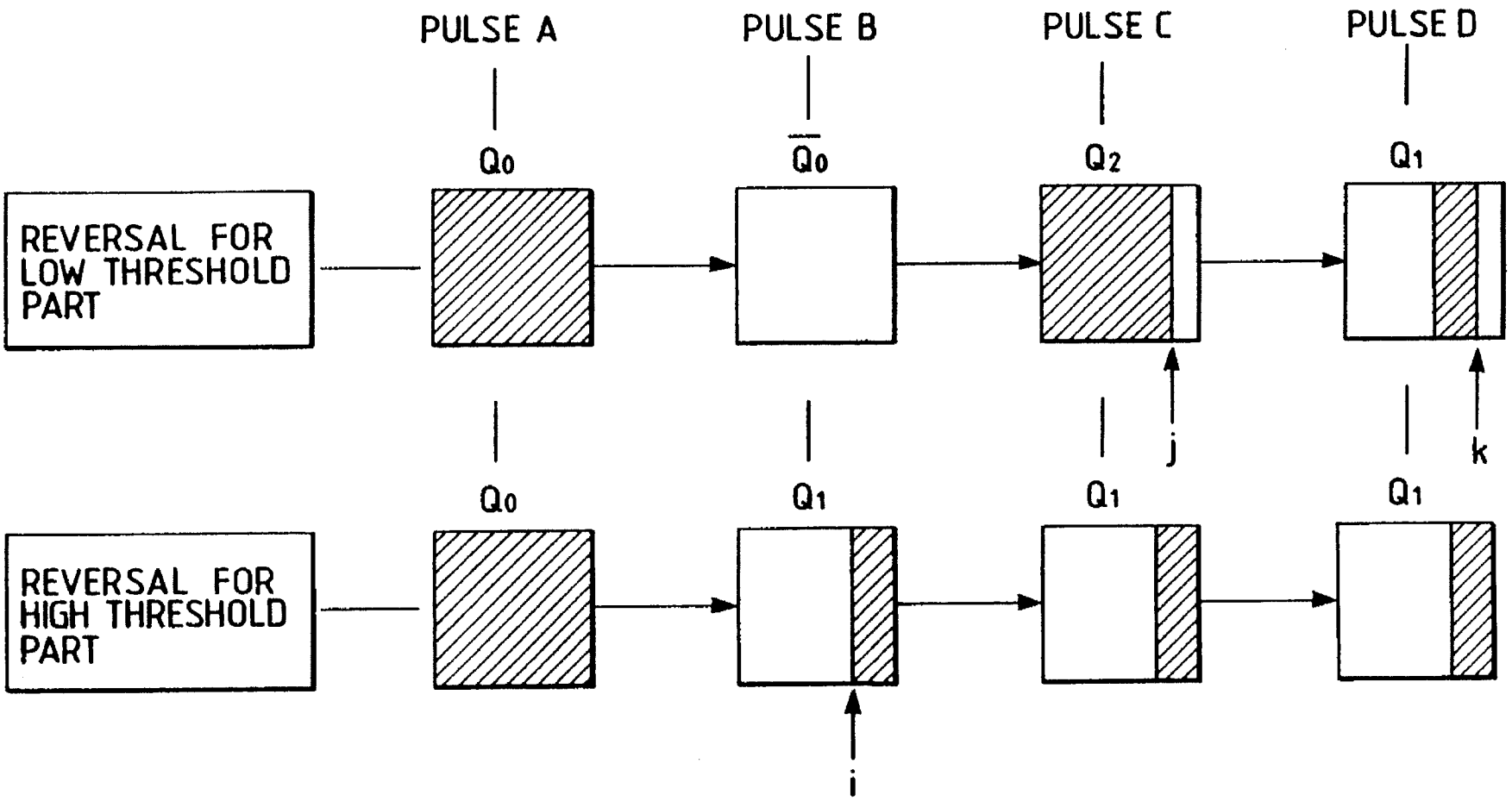
FIG. 8 PRIOR ART
FIG. 8 is a view for explaining a driving method according to the four-pulse method.

Now, the description will be made of the tonal information writing operation by the application of the driving waveforms shown in FIG. 1. The variational pixel states by the application of each of the pulses A to D are the same as those shown in FIG. 8.

At first, the total pixels on the scanning line are reset by the application of the pulse A. Then, writing is executed by the application of the pulse B for the pixels in a portion having a high threshold value on the scanning line. In this case, overwriting takes place in the pixels in a portion having a low threshold value. Subsequently, by the application of the pulse C, a given area of the pixels in the portion of the low threshold value is rewritten into the reversed condition. Then, the pulse D, the portion of the low threshold from value is rewritten to provide it with the same tonal content as the portion having the high threshold value. In short, the writing operation for the portion having the high threshold value is terminated by the application of the pulses A and B, but for the portion having the low threshold value, the writing is terminated by the further application of the pulses C and D.

Therefore, in order to write the total pixels on one scanning line, the periods $T_a$, $T_b$, and $T_c$ are needed as shown in FIG. 1. Here, the pulse A is superposed with the other information signals when it is applied. This is not included in the time required for writing one line. To determine the length of each of the periods $T_a$, $T_b$, and $T_c$, are the fluctuations of the threshold value in each pixel on the one scanning line, but the fluctuations of this threshold value is mainly due to temperature fluctuations. When such a temperature distribution on one scanning line is 30° to 40° C, each of the threshold values for the upper limit (40° C.) and the lower limit (30° C.) of the temperature range which can be compensated by the four-pulse method is set to be approximately 18.4 volt in terms of voltage by making the pulse width of the pulse B 40 μs, the pulse width of the pulse C 29 μs and the pulse width of the pulse D 22 μs. However, these values are those at the points where the cell thickness d is constant (d: 1.3 μm).

The other setting examples and the time required for one scanning in applying the pulse widths thus set to the driving signals in FIG. 1 are shown in Table 1.

TABLE 1

| Threshold voltage (V) | Pulse width (μs) Pulse B | Pulse C | Pulse D | Time required for one scanning (μs) By waveforms shown in FIG. 1 |
|---|---|---|---|---|
| 15.9 | 50 | 35.7 | 21.5 | 214.4 |
| 18.4 | 40 | 28.6 | 17.3 | 171.8 |
| 22.9 | 30 | 21.4 | 13.2 | 129.2 |

As shown in Table 1, according to this method, when the voltage supply by the driving IC is approximately 16 volt, 214.4 s are required for one scanning; 18.4 volt, 171.8 μs; and 22.9 volt, 129.2 μs. In contrast, according to the conventional example shown in FIG. 3, the time required for one scanning becomes longer as shown in Table 2 because this method is to control only the value of the wave height of each of the pulses.

TABLE 2

Figure 3:
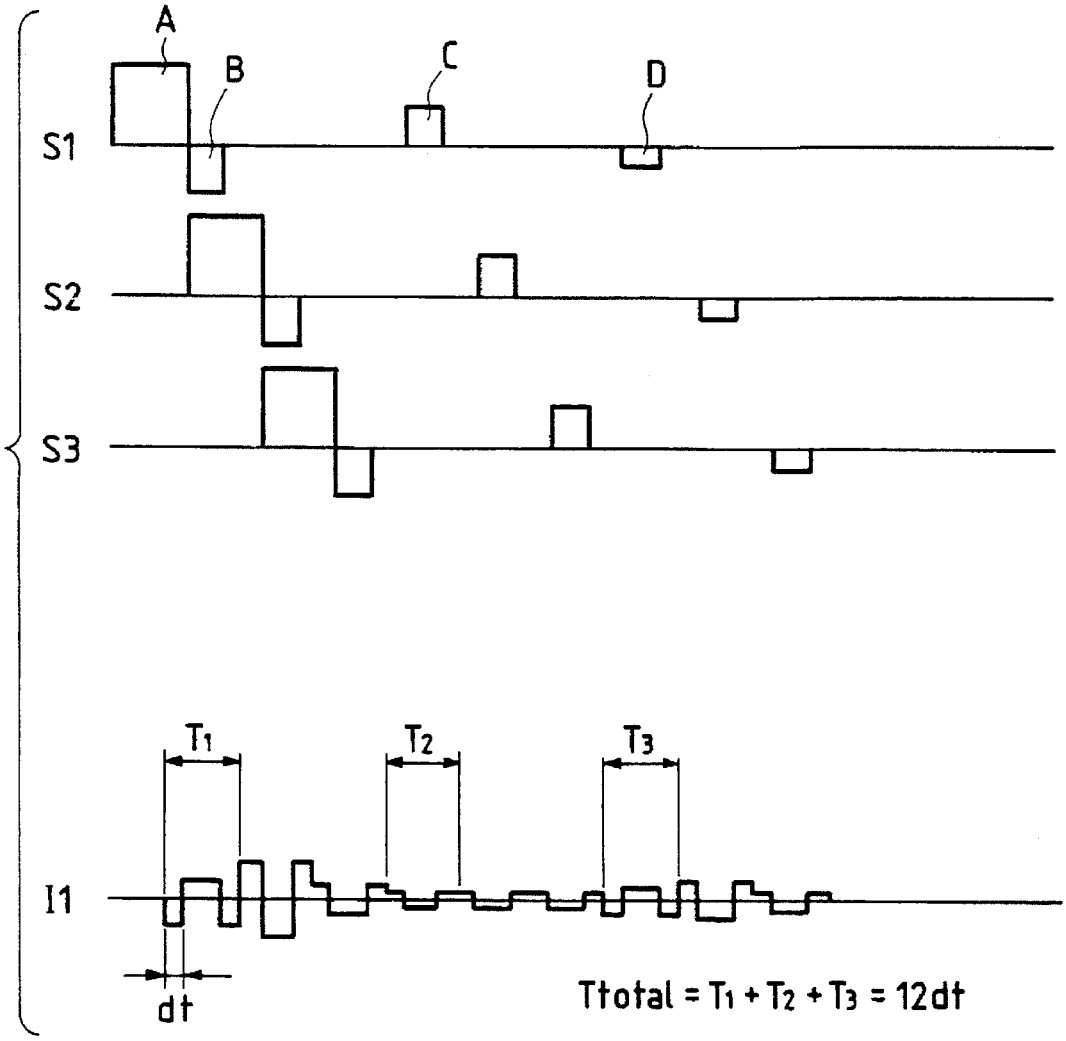
FIG. 3 PRIOR ART
FIG. 3 is a time chart showing driving signals according to the conventional four-pulse method.

| Pulse width fixed (μs) | Threshold voltage (V) Pulse B | Pulse C | Pulse D | Time required for one scanning (μs) By conventional waveforms shown in FIG. 3 |
|---|---|---|---|---|
| 50 | 15.9 | 11.4 | 10.7 | 300 |
| 40 | 18.4 | 13.1 | 11.0 | 240 |
| 30 | 22.9 | 16.4 | 13.6 | 180 |

In comparing Table 1 and Table 2, it is clear that even if the maximum value of the supply voltage from the driving IC (15.9 volt, for example) is the same, there is a significant difference in the time required for one scanning. Table 3 shows the time required for one scanning by the prior art and the present embodiment at these three maximum voltages and the ratio of the present embodiment to the prior art which is defined as 1 for each case.

TABLE 3

| Maximum supply voltage (V) | Time required for one scanning (μm) Prior art | Present embodiment | Ratio of the present embodiment |
|---|---|---|---|
| 15.9 | 300 | 214.4 | 0.71 |
| 18.4 | 240 | 171.8 | 0.71 |
| 22.9 | 180 | 129.2 | 0.71 |

According to Table 3, there is clearly an effect in shortening the scanning time by the use of the present invention.

Figure 10:
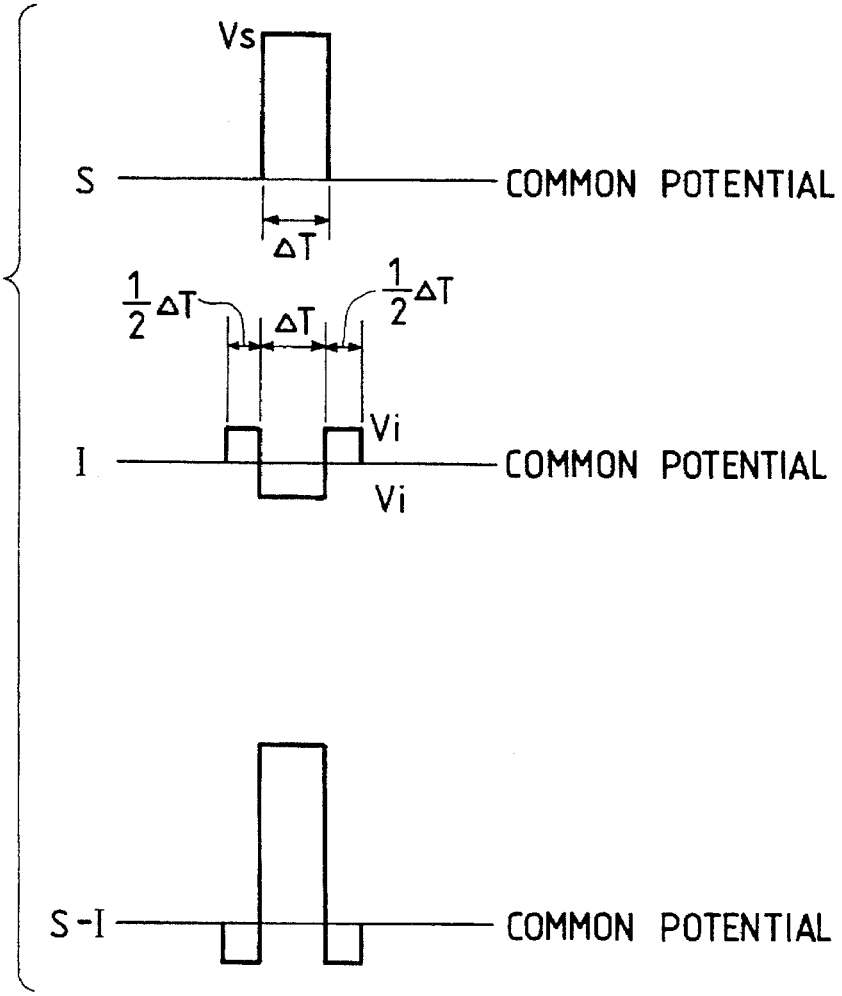
FIG. 10 is a waveform diagram showing the waveform of scanning signals which is a fundamental pattern of the driving waveform represented in FIG. 1, information signal waveform, and synthesized waveform thereof.

In this respect, the waveform of the scanning signal S (pulses A, B, and C) which is the fundamental pattern of the driving waveform used for the present embodiment, the waveform of the information signal I, and the synthesized waveform S-I of these ones are shown in FIG. 10. Also, the properties of the FLC materials used for the present embodiment are shown in Table 4.

TABLE 4

FLC

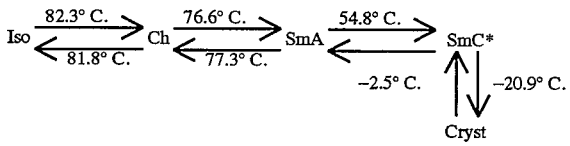

| | |
|---|---|
| Ps = 5.8 nC/cm$^2$ | 30° C. |
| Tilted = 14.3° C. | 30° C. |
| $\Delta\epsilon \sim 0$ | 30° C. |

According to another specific example of the present invention, writing of tonal information to a certain pixel is such that at first, the total pixels are reset to one stable condition by the application of the resetting pulse and then the writing contents are sequentially determined by the following write pulses beginning with the portion having the high threshold value. At this juncture, however, the reversal threshold value of the liquid crystal at the time of each application of the writing pulse is regularized because the effects produced until then by the information signals to the other pixels on the same information signal electrode is eliminated.

Figure 11:
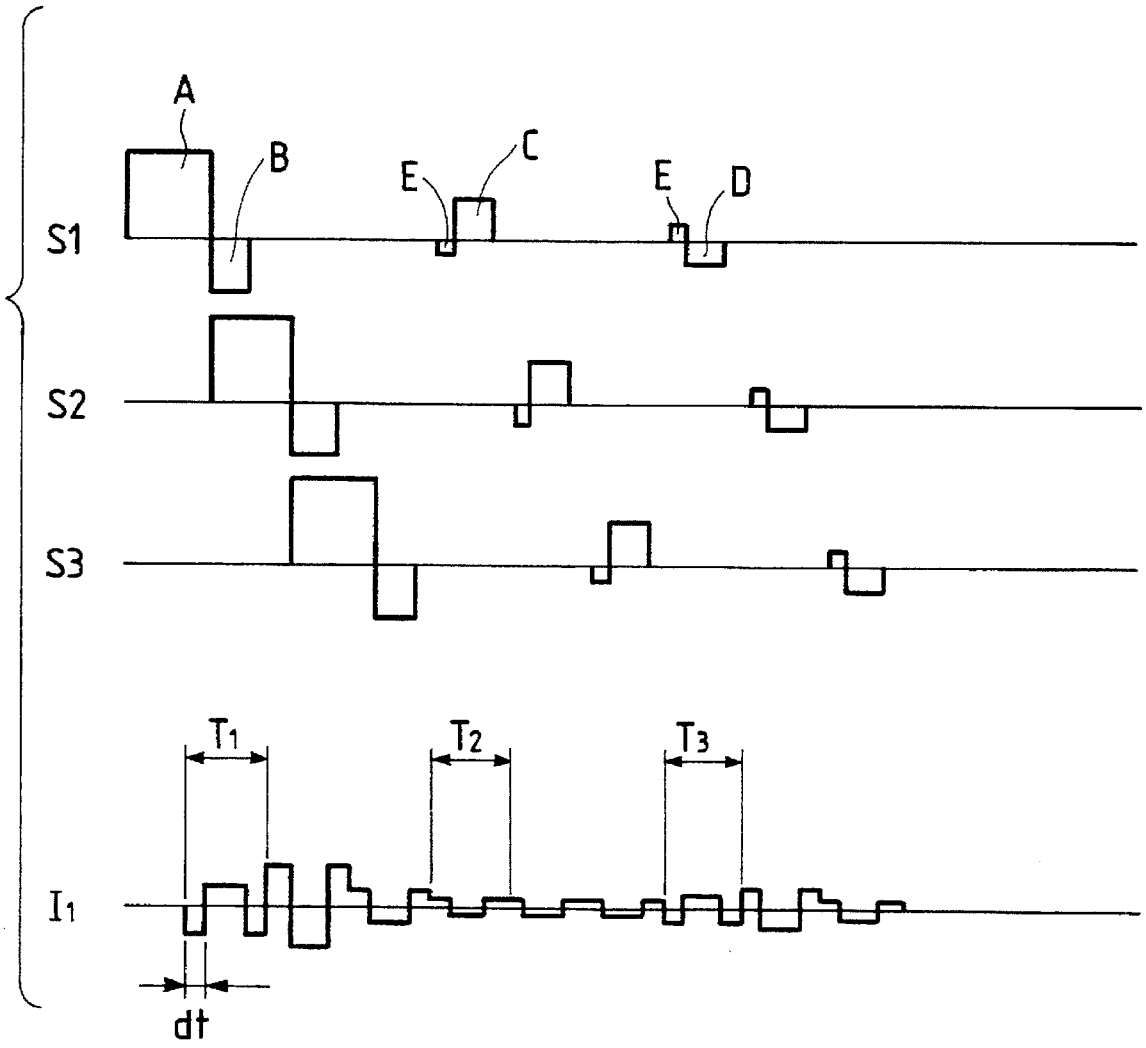
FIG. 11 is a time chart showing the scanning signals and information signals in a ferroelectric liquid crystal display according to an embodiment of the present invention and a view showing the electrode arrangement in a general matrix element.

Now, FIG. 11 is a time chart showing the scanning signals S1 to S3 and information signal $I_1$ sequentially applied in a ferroelectric liquid crystal display according to an embodiment of the present invention. Each of the scanning signals is formed by four pulses A to D and two pulses E immediately before the pulses C and D. Here, for explanation, matrix driving waveforms are represented for a case where the information signal line is one while the scanning signal line are three.

Subsequently, the description will be made of the writing operation for tonal information the use of the driving waveforms shown in FIG. 11. The variational states of pixels by the application of each of the pulses A to D are the same as those shown in FIG. 8.

At first, the total pixels on the scanning line are reset by the application of the pulse A. Then, writing is executed by the application of the pulse B to the pixels in the portion having a high threshold value on the scanning line. In this case, overwriting takes place in the pixels in the portion having a low threshold value. Next, by the application of the pulse C, a given area of the pixels in the portion having a low threshold value is rewritten to the reversed condition. Then, from the pulse D, the portion having the low threshold value is rewritten so as to provide it with the same tonal content as the portion having the high threshold value. In short, for the portion having the high threshold value, the writing is terminated by the pulses A and B, but for the portion having the low threshold value, the writing is terminated by further application of the pulses C and D.

Here, the two pulses E to be applied immediately before the pulses C and D constitute the principal points of the present invention. These pulses E are characterized in that the difference from the corresponding information signals, that is, the electrical potential between the substrates which is applied to liquid crystals by these signals, is smaller than the threshold value of the liquid crystal irrespective of the kinds of the information signals and has opposite polarity to the write signals. The reason why the difference is made smaller than the threshold value of the liquid crystal is that it is necessary to prevent the positional variation of the domain walls in the pixels which have already been written, and the reason why it has the opposite polarity is that it is necessary to enable the threshold values by the following pulses C and D to be stabilized (regularized).

Figure 12A:
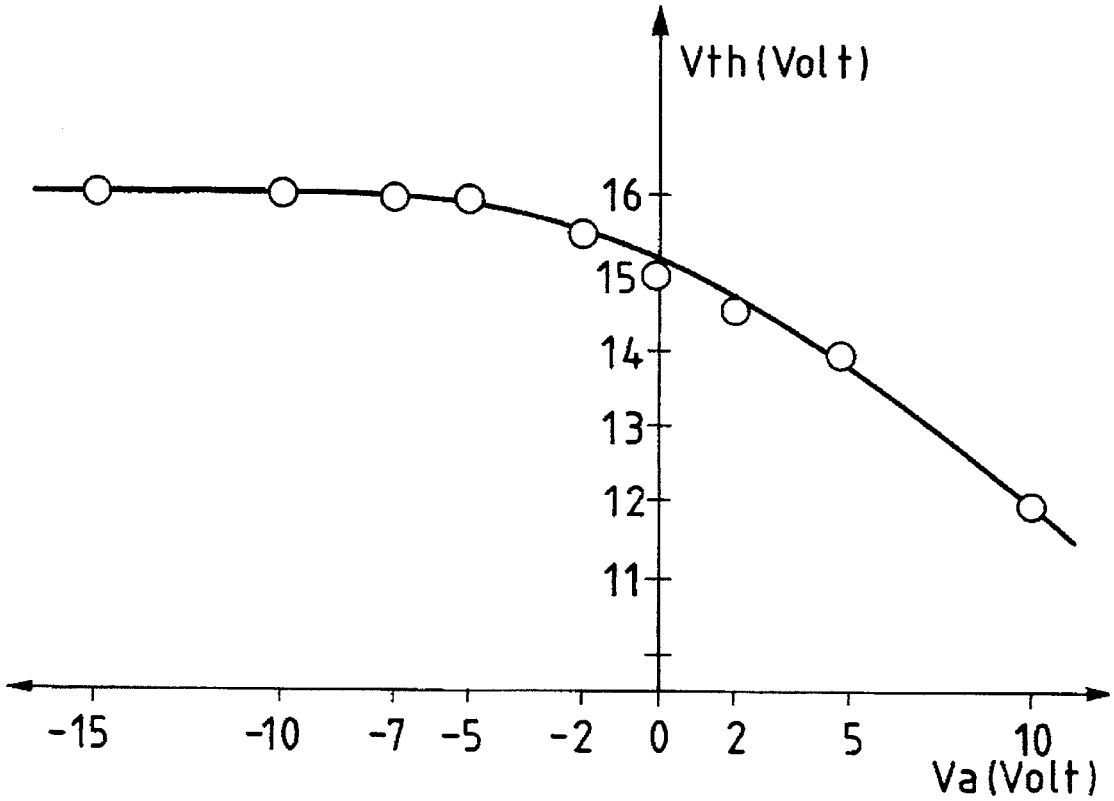
FIGS. 12A and 12B are views for explaining the relation between the voltage valure of a write pulse and the threshold value of the voltage applied to the immediately preceding pulse.
Figure 12B:
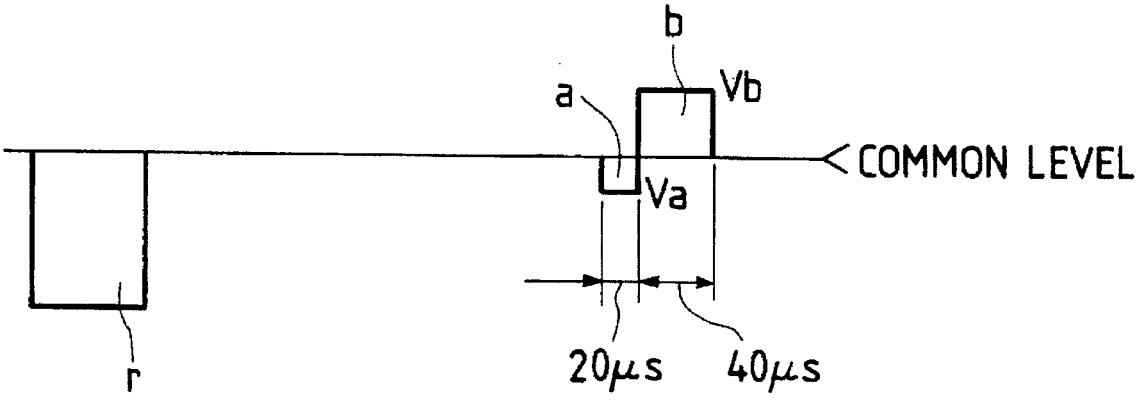

FIG. 12A is a graph showing the relation between the voltage value $V_a$ of a pulse a where the pulse a having the opposite polarity thereto is applied immediately before the application of a write pulse b as shown in FIG. 12B and the threshold voltage $V_{th}$ by the application of the write pulse b. Here, a reference mark r designates a reset pulse. As is clear from FIGS. 12A and 12B, in order to make the threshold voltage $V_{th}$ constant, it is desirable to set the voltage value $V_a$ of the pulse a at the value which is higher than the value of the wave height where the wave height value causes the variation of the threshold voltage $V_{th}$ to be saturated even when the wave height value is the lowest, that is, approximately −5 volt or less in the case represented in FIG. 12A.

Also, as in the case of the present embodiment where the cell thickness is distributed in the pixels, it is preferable for the voltage of the lowest value of the wave height to regard the saturation value in the thickest portion of the cell thickness as its standard. However, in this case, it is necessary to prevent such a value from exceeding the threshold value in the thinnest portion of the cell thickness. In other words, the scanning signal and the information signal should be designed to satisfy these conditions.

As described above, according to the present invention, the driving signal is formed by a resetting pulse and a plurality of pulses wherein the pulse width of the following pulses is shorter than the pulse width of the preceding pulses; thus making it possible to significantly shorten the image representation time as well as significantly improve the display characteristics of analogue tonal display using FLC in terms of its representation velocity.

Also, according to the present invention, the arrangement is made so that a pulse having opposite polarity to a write pulse but not producing any effect on the contents already written is applied immediately before the write pulse; hence making it possible to perform stable tonal display independent of the pixel conditions immediately before writing.

What is claimed is:

1. A liquid crystal display comprising:

a scanning electrode group and a signal electrode group each formed on a substrate and arranged in a matrix with pixels formed at intersections therebetween;

a displaying portion between said electrode groups filled with liquid crystal, which exhibits multistable optical transmittance in accordance with an electric field applied thereto, for performing image and information display; and means for applying to said liquid crystal, through each of said electrode groups, driving signals comprising a pulse to completely reset all pixels on a selected scanning electrode to one stable condition, and a plurality of subsequent pulses, having opposite polarities to each other, to determine a content to be written into one of the pixels, wherein a pulse width of each pulse is shorter than pulse widths of all the preceding pulses from among the plurality of subsequent pulses, wherein the distance between one of the scanning electrodes and one of the signal electrodes at a crossing area is varied in a direction parallel to a surface of one of the substrates, and wherein, while a first pulse of the plurality of subsequent pulses is being applied to all the pixels on the selected scanning electrode, the pulse to completely reset is being applied to all pixels on a subsequently selected scanning electrode.

2. A ferroelectric liquid crystal display according to claim 1, wherein an amplitude value of each of the pulses to determine the content to be written is equal.

3. A ferroelectric liquid crystal display according to claim 1, wherein the structure enables a stabilized reversal threshold value in response to the reset and subsequent pulses to be uniformly distributed over all pixels.

4. A liquid crystal display according to claim 1, wherein said liquid crystal is a ferroelectric liquid crystal.

* * * * *

UNITED STATES PATENT AND TRADEMARK OFFICE

CERTIFICATE OF CORRECTION

PATENT NO. : 5,650,797

DATED : July 22, 1997

INVENTOR(S) : SHINJIRO OKADA

It is certified that error appears in the above-identified patent and that said Letters Patent is hereby corrected as shown below:

COLUMN 2

Line 15, "Of" should read --of--.

COLUMN 3

Line 59, "the" should read --one--.

COLUMN 6

Line 41, "214.4 s" should read --214.4 μs--.

Signed and Sealed this

Thirteenth Day of January, 1998

Bruce Lehman

*Attest:*

BRUCE LEHMAN

*Attesting Officer*

*Commissioner of Patents and Trademarks*